US005870959A

United States Patent [19]

Barksdale

[11] Patent Number: 5,870,959

[45] Date of Patent: Feb. 16, 1999

[54] FOLDING PROMOTIONAL TABLE

[76] Inventor: Elijah M. Barksdale, 8001 N. Main St., Kansas City, Mo. 64118

[21] Appl. No.: 898,372

[22] Filed: Jul. 22, 1997

[51] Int. Cl.[6] ..... A47B 3/00

[52] U.S. Cl. ..... 108/115; 108/132

[58] Field of Search ..... 100/173, 175, 100/176, 179, 162, 115, 11, 18, 132

[56] References Cited

U.S. PATENT DOCUMENTS

| | | | |
|---|---|---|---|
| 317,097 | 5/1885 | Danner | 108/132 |
| 1,133,109 | 3/1915 | Derbyshire | 108/132 |
| 3,436,092 | 4/1969 | Werner | 108/115 X |
| 3,628,471 | 12/1971 | Burr | 108/132 |
| 4,059,058 | 11/1977 | Kazuhide | 108/132 X |
| 4,318,353 | 3/1982 | Scvhier | 108/132 |

FOREIGN PATENT DOCUMENTS

| | | | |
|---|---|---|---|
| 1449560 | 8/1966 | France | 108/173 |

*Primary Examiner*—Jose V. Chen

*Attorney, Agent, or Firm*—Spencer Fane Britt & Browne LLP

[57] ABSTRACT

A table is provided for the display and promotion of items which can provide a fully side enclosed and recessed table surface or provide a table surface which is enclosed on the sides of the table and open to the front and rear of the table and which can be folded and stored in a space which is less than one-fifth the space required for the table in its unfolded condition.

4 Claims, 5 Drawing Sheets

FOLDING PROMOTIONAL TABLE

BACKGROUND OF THE INVENTION

This invention relates to display tables used in presenting merchandise for sale in wholesale and retail stores and in convention and traveling sales exhibits. Merchandisers typically wish to present their goods in an open manner and make the merchandise available to potential purchasers to examine and handle. This open display presents several problems for the merchandiser.

First, it is desirable for the merchandise to be presented in an open, available manner, but it is also desirable for the merchandise to be reasonably confined so the display area does not become messy and the merchandise pushed off the display table and onto the floor. This confinement is accomplished by providing sidewalls which extend upwardly from the display surface to enclose the merchandise.

While tables have existed which accomplish these goals, they are fabricated as a solid table presenting fixed side and end pieces. Such fixed component tables consume a great deal of space when in storage and require at least two people to move the table about the store. These tables are generally found in standard sizes ranging from 36" to 60" long and being 30" high and 24" to 30" wide. These common dimensions present a consumption of storage space ranging from 15 square feet to nearly 32 cubic feet per table not in use on the sales floor. Since retail space and convention space is always at a premium and costly, the need to reduce the amount of space used for the storage of display tables is very important to sales management.

A second problem with the existing fixed-side display tables is that two or more people are needed to move the tables around in a store. Also, the use of such large, fixed-side tables for a mobile exhibit is prohibited by the cost and inconvenience of moving such tables. It will be appreciated that these display tables cannot be made from lightweight materials and perform well in public sales floor situations. The pushing and shoving of the public against the table would tend to cause a light-weight table to slide from its position and disrupt the sales floor.

It will also be appreciated that as display tables of substantial weight cannot be avoided, it is beneficial if the table can be easily and compactly moved or shipped from one location to another. These benefits cannot be obtained in the conventional display table as it is not compact. The only current method for convenient shipment of such display tables is to remove any securing bolts and break the table down in to separate pieces for shipment. This consumes time and substantial effort and presents the potential for the loss of component parts and securing bolts.

Therefore a need exists for: a promotional display table which is sufficiently substantial so as to provide a solid display surface; a table which can be conveniently moved about the retail or show room floor by one or two people; a table which can be easily and compactly shipped from one location to another; a table which can be compacted into a configuration which consumes less storage space than does the same table when in use; and a table that when compacted does not present independent component parts which can become separated and lost.

These features and more a provided in the inventive folding promotional table present herein and which is fully described in the accompanying figures and written description.

SUMMARY OF THE INVENTION

The objectives of the present invention include providing a merchandise display table which can be folded into a compact unit for movement and storage.

Another objective of the present invention is providing a foldable display table which confines the merchandise to the display table area and which presents all the foldable components in an interconnected array so table parts are not lost.

Another object of the present invention is to provide a foldable display table which, when in its folded configuration, can be easily moved by a single individual and which can be manipulated about a confined space such as narrow store isles without the need to move adjacent display tables which are in the unfolded configuration and which contain goods for sale.

Yet another objective of the present invention is to provide a foldable display table having a storage space requirement which is, approximately, less than one-fifth the amount of space required for the same table when in its open or unfolded position.

Still another objective of the present invention is to provide a foldable display table which permits the user to rearrange the foldable components to provide a display table presenting a display surface which can be alternated between presenting a full sidewall enclosure of the display table surface and presenting a display table surface with only two or three display surface sidewalls.

These objectives and advantages are obtained by a foldable display table comprising a table top-edge, a display surface downwardly-spaced from said table top edge, the display surface having a front edge, a back edge, a first side edge and a second side edge, a perimeter sidewall enclosing the display surface, the sidewall extending downwardly from the table top edge to contact and enclose the display surface, the perimeter sidewall comprising a front panel presenting a top edge and a bottom edge, the front panel being hingedly connected to the display surface front edge, the front panel being movable between open and closed positions such that when the front panel is in an open position the front panel top edge is spaced vertically from the display surface to form a front side of the table top edge, and the panel forms a front sidewall segment of the perimeter sidewall, a rear panel presenting a top edge and a bottom edge, the rear panel being hingedly connected to the display surface back edge, the rear panel being movable between open and closed positions such that when the rear panel is in said open position said rear panel top edge is spaced vertically from said display surface to form a back side of said table top edge and said panel forms a back sidewall segment of said perimeter sidewall a first end panel having a top edge and a bottom edge, said first end panel being hingedly connected to said display surface first side edge and being movable between open and closed positions such that when said first end panel is in said open position said first end panel top edge is spaced vertically from said display surface to form a first end of said table top edge and said first end panel forms a first end sidewall segment of said perimeter wall, and said first end panel bottom edge extends to support and space said display surface from the ground, a second end panel having a top edge and a bottom edge, said second end panel being hingedly connected to said display surface second side edge and being movable between open and closed positions such that when said second end panel is in said open position said second end panel top edge is spaced vertically from said display surface to form a second end of said table top edge and said second end panel forms a second end sidewall segment of said perimeter wall, and said second end panel bottom edge extends to support and space said display surface from the ground, said front, rear, first end, and second end sidewall segments contacting the adjacent panels to form said perimeter sidewall and to generally enclose said display surface and, a generally parallel planar interconnected array comprising said panels and said display surface said parallel planar array being formed when in said panels are moved to said closed position to allow interconnected, compact storage of the display table and cartage of the table by and individual.

The foregoing and other objects are not meant in a limiting sense, and will be readily evident upon a study of the following specification and accompanying drawings comprising a part thereof. Other objects and advantages of this invention will become apparent from the following description taken in connection with the accompanying drawings, wherein is set forth by way of illustration and example, an embodiment of this invention.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DETAILED DESCRIPTION OF THE PREFERRED EMBODIMENTS

Figure 1:
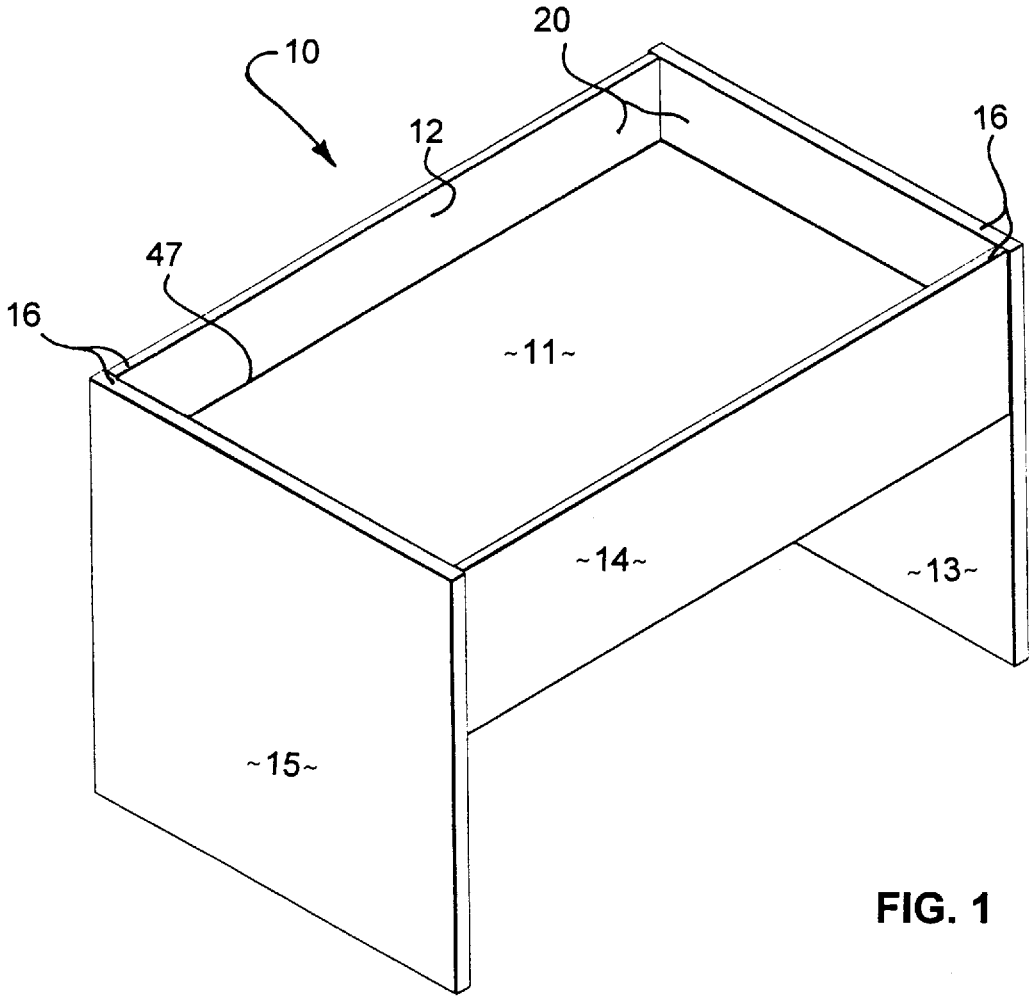
FIG. 1 is a left side, top and front perspective view of the invention shown with all panel components in open position to provide a recessed and enclosed table surface.

Referring to FIG. 1 inventive table 10 is shown in the open or unfolded configuration. The configuration of FIG. 1 is achieved by the interrelation of the side panels 12, 14 and end panels 13, 15 to form a sidewall perimeter 20 which encloses display surface 11. As shown in FIG. 1, display surface 11 is recessed, or downwardly spaced, from table top edge 16 and the front edge, back edge and ends of display surface 11 are contacted and surrounded by sidewall perimeter 20. This spaced relation between table top edge 16 and display surface 11 provides a well or depression for holding goods and merchandise which is enclosed by sidewall perimeter 20. In this manner goods and material for display on table 10 are retained on the table even during shuffling and handling of the material by buyers. In addition, the perimeter wall 20 prevents a passerby from brushing goods off of the table and onto the floor.

It will be appreciated that front and rear panels 12, 14 each present a top edge which forms a portion of table top-edge 16 when panels 12, 14 are in the open, upright position as shown in FIG. 1. Similarly, end panels 13, 15 also present a top-edge which forms a top-edge portion of table top-edge 16 when panels 13, 15 are unfolded to support display surface 11. When panels 12, 14 and end panels 13, 15 are in the open position the top-edge portions of each panel converge to form table top-edge 16 which is vertically spaced from display surface 11. It will further be appreciated by examination of FIG. 1 that when panels 12, 14 and end panels 13, 15 are in the open position each of these panels forms a sidewall segment of perimeter sidewall 20 and contacts the adjacent panel sidewall portions in order to effect enclosure of display surface 11.

Still referring to FIG. 1, table surface 11, in the open position, is supported and spaced from the ground by end panels 13, 15. End panels 13, 15 provide a solid base for support of table 10. When in the open position, end panels 13, 15 are secured by catch mechanism 45 (FIG. 4) to front and rear panels 12, 14. The securing of end panels 13, 15 to front and rear panels 12, 14 prevents pressure directed against either end panel 13 or end panel 15 from causing accidental sideways movement of table 10 which could cause end panel 13 or end panel 15 to fold under table 10 and into the closed position (FIG. 3) while table 10 is in use.

Figure 2:
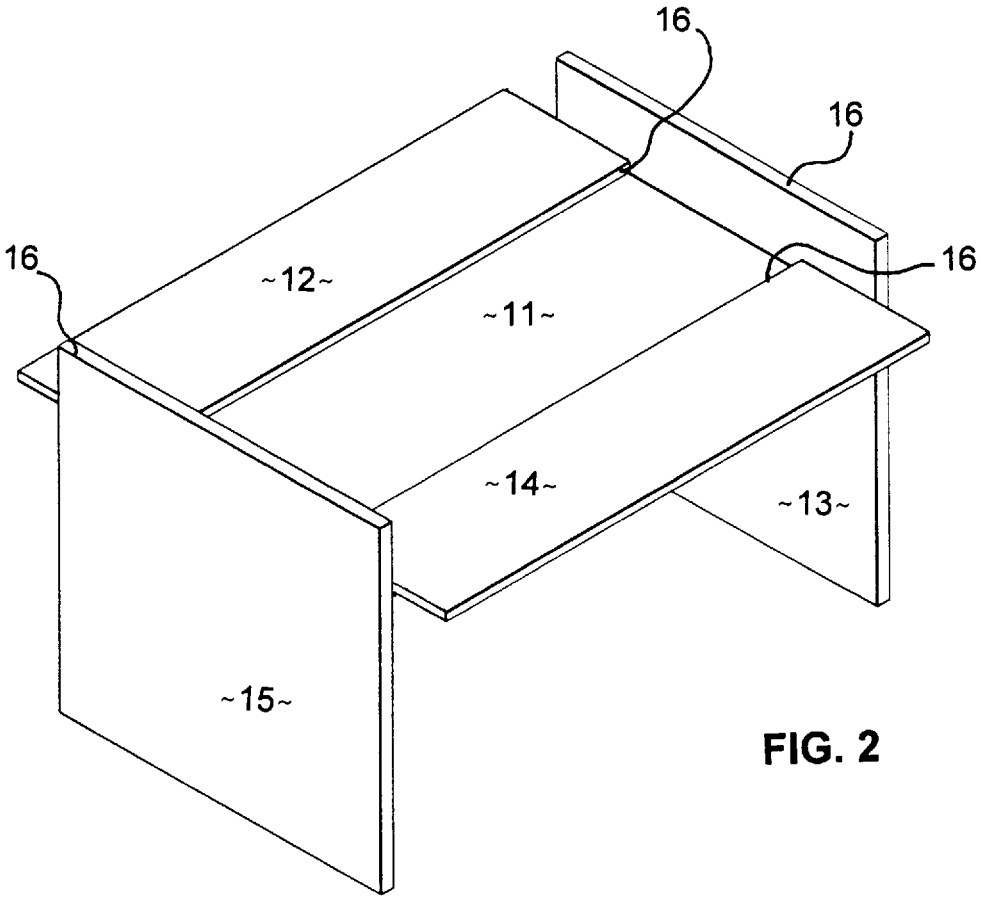
FIG. 2 is a left side, top and front perspective view of the invention shown with the end panel components in open position and the front and rear panel components in closed position to provide a table surface which is directly accessible from the front and rear while providing end capture of the surface contents.

Referring now to FIG. 2, table 10 is shown with front and rear panels 12, 14 in the closed or down position. This is accomplished by disengaging catch 45 (FIG. 4) which secures panels 12, 14 to end panels 13, 15 and lowering panels 12, 14 into a flat position or parallel planar position with display surface 11. When panels 12, 14 are in the closed position table display surface 11 may be accessed from either side and the display surface 11 is closed off only at the ends by end panels 13, 15. Alternatively, only one of panels 12, 14 can be placed in the closed position (FIG. 2) and the other panel 12, 14 be retained in the open position (FIG. 1). In this manner of use display surface is closed off on three sides and the remaining side is open and effectively extends the size of display surface 11.

The ability to modify the configuration of table 10 is a significant feature. While it is desirable to be able to confine the merchandise to the enclosed display surface 11 which is achieved when panels 12, 14 are in the open or upright position, it is also very desirable to be able to achieve a configuration of table 10 which allows shorter people, such as children, or people in wheelchairs to see and examine the merchandise on table 10. Display tables which have only upward extending side rails which surround the table prevent access to the goods by persons in wheelchairs and by children. Inventive table 10 allows a retailer to provide access to both these groups of people at any location in the store and without the need to purchase special display tables and make special allocation of those particular display tables or to reposition display tables.

Figure 4:
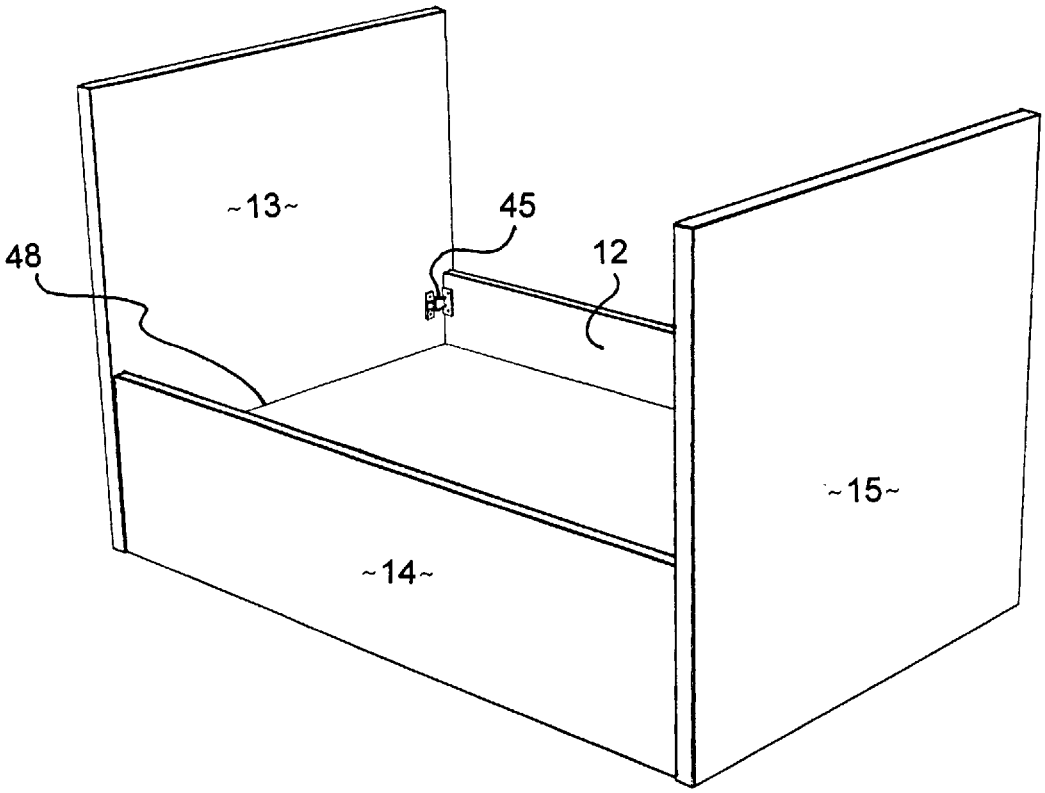
FIG. 4 is a bottom and front perspective view of the invention and showing the latch mechanism for securing the end panels to the front and rear panels.
Figure 5:
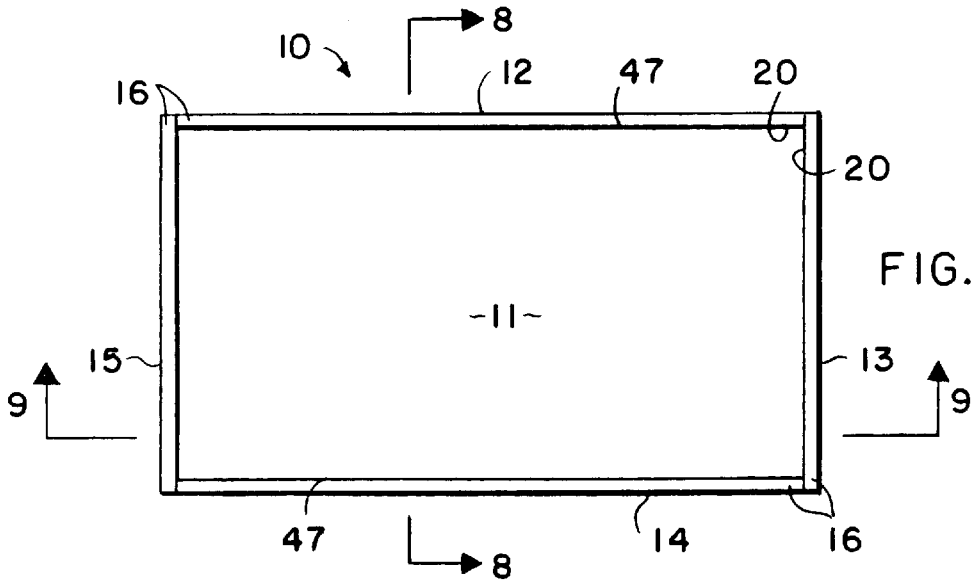
FIG. 5 is a top view of the invention.
Figure 6:
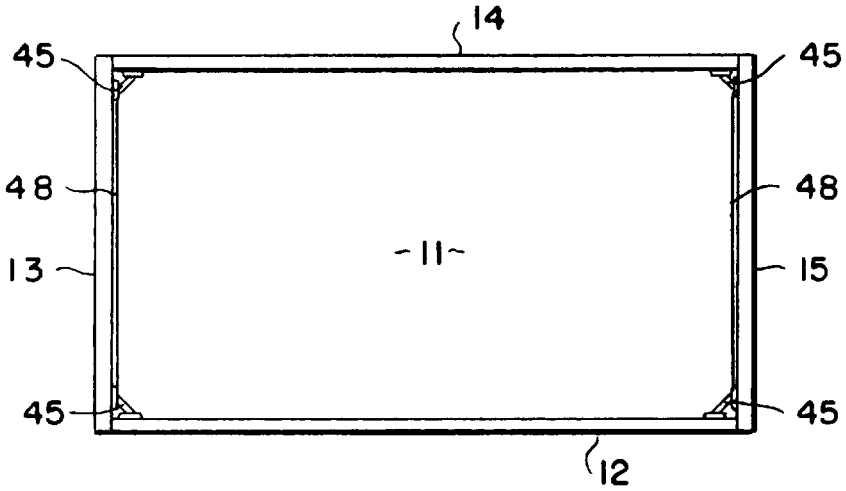
FIG. 6 is a bottom view of the invention.
Figure 7:
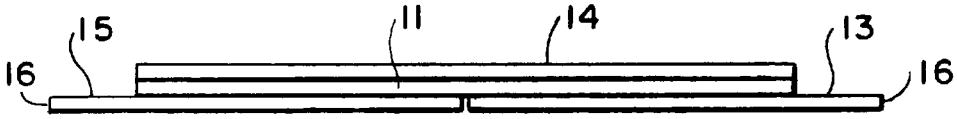
FIG. 7 is a view showing the folded position of the table.
Figure 8:
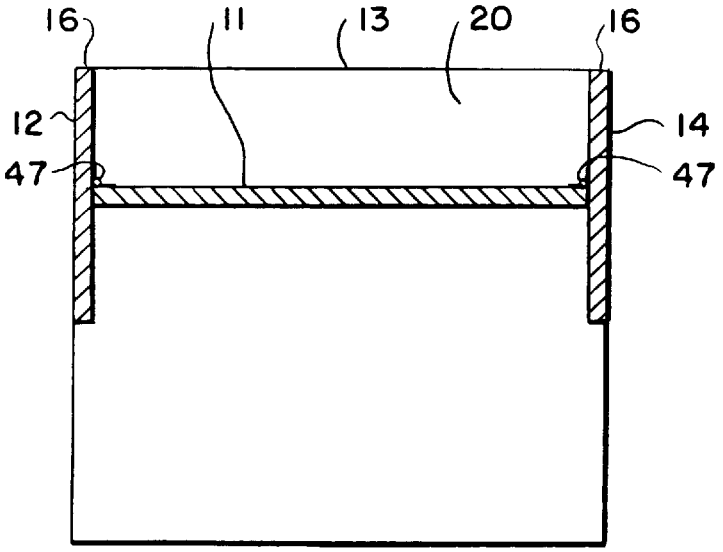
FIG. 8 is a cross section view of line 8—8 of FIG. 5.
Figure 9:
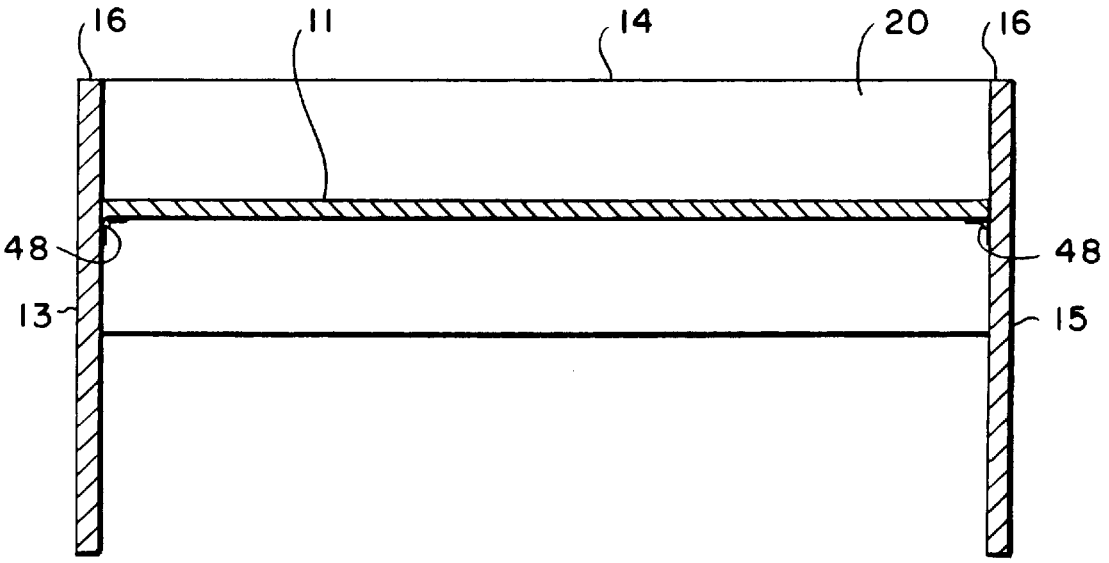
FIG. 9 is a cross section view of line 9—9 of FIG. 5.

It will also be appreciated that when table 10 is configured in the semi-enclosed fashion—with one or both of front and rear panels 12, 14 in the closed position—display surface 11 is extended and larger goods or additional quantities of materials may be presented on display surface 11. When table 10 is configured such that only panel 12 or panel 14 is in the closed position, the end panels 13, 15 are locked to the panel which is in the open position by catch mechanism 45 (FIG. 4). In addition, the portion of panel 12, 14 which extends below table display surface 11 abuts against end panel 13, 15 to inhibit unintended collapse or folding of end panel 13, 15 even when catch mechanism 45 is not engaged to lock front and rear panels 12, 14 to end panels 13, 15. In this configuration table 10 is fully secure and it is not possible for any side-directed force to fold-under panel 13, 15. However, should a user determine to present table 10 for use with both panels 12, 14 in the closed position, it is best if the ends are protected from side directed forces as it might be possible for end panel 13, 15 to be dislodged from supporting display surface 11.

Figure 3:
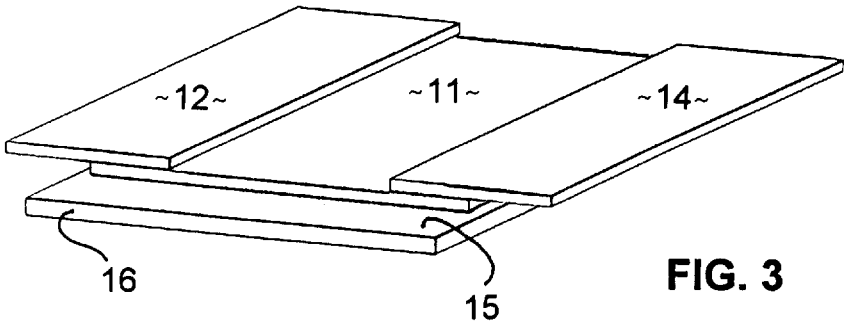
FIG. 3 is a left side, top and front perspective view of the invention shown with the end panel components in closed position and the front and rear panel components in closed position to permit transportation of the invention and to provide reduced storage requirements when the invention is not in use.

Referring now to FIG. 3 the manner of collapsing table 10 into the fully closed position will be examined. When it is desired to store or ship or move table 10 the table panels 12, 14, 13, and 15 can be hingedly collapsed against display surface 11 to provide a generally parallel planar interconnected array of panels which are fully interconnected by hinge pieces between each panel 12, 13, 14, 15 and display surface panel 11. In this manner the possibility for loss of any of the component panels or pieces of table 10 is eliminated and the table can be repositioned or shipped across country without fear that it will be unusable at the destination due to loss of a critical part.

To collapse table 10 into the configuration of FIG. 3 from the configuration of FIG. 1, a user releases catch mechanism 45 (FIG. 4) at either side of panel 13 to release panel 13 from secure attachment to panels 12, 14 and lowers the panel 13 end of table 10 to the ground while folding the lower portion of panel 13 under table 10. Similarly, the user then collapses end panel 15 by releasing catch mechanism 45 (FIG. 4) at either side of panel 15 to release panel 15 from secure attachment to panels 12, 14 and lowers the panel 15 end of table 10 to the ground. At this point in collapsing table 10 into the configuration of FIG. 3 the end panels 13, 15 are fully collapsed and table 10 is resting on the ground with panels 13, 15 underneath display surface 11. To finish collapsing table 10 into the FIG. 3 configuration front and rear panels 12, 14 are folded inwardly to rest against display surface 11. Upon completion of the collapsing procedure table 10 is in the configuration of FIG. 3 and presents an array of panels which are still interconnected to each other by the hinge pieces about which the panels fold and the panels are generally in parallel planes with the plane of display surface 11. When in this interconnected parallel planar array the now compact table 10 may be moved by a single individual and stored in a substantially reduced amount of space and conveniently shipped to another location. In addition, the interconnection feature of table 10 eliminates the possibility of the loss of parts during shipment and movement which would render table 10 useless.

When table 10 is collapsed into the configuration shown in FIG. 3 table 10 consumes approximately one-fifth of the space it requires when in the configuration of FIG. 1. This aspect of table 10 is a significant improvement over previous display tables which either had to be in use on the display floor or take up 15 to 32 cubic feet of storage space.

It is also possible with table 10 configured with front and rear panels 12, 14 in the closed position—a user can insert a filler panel, not shown, into the depression created in the center of display surface 11 by the closure of panels 12, 14. In this manner display surface 11 may be enlarged to extend across closed front and rear panels 12, 14 and be converted to a uniform level by insertion of the filler panel. It will also be appreciated that a similar procedure can be utilized which involved closure of only one of panels 12, 14. In this configuration either panel 12 or panel 14 is placed in the closed position while the opposing panel 12, 14 is allowed to remain in the open position. This configuration provides unrestricted access to one side of display surface 11 while provided an enlarged display surface 11. If desired, an appropriately dimensioned filler panel can be placed in display surface 11 adjacent to the top edge of closed position panel 12, 14 to thereby present a display surface of uniform level. It will be appreciated that it is not required that a uniform level display surface be presented through the addition of filler panels. The insertion of filler panels is a matter of and that this is optional when one or both of front and rear panels 12, 14 are placed in the closed position. While some goods and materials may be more stable when a fully level surface is provided, the display of other goods such as shirts, socks or loose materials will not be affected by the two levels presented when one or both of panels 12, 14 are placed in the closed position to achieve an increase in size of display surface 11.

Referring now to FIG. 3 table 10 is shown in a fully closed position suitable for storage or movement within a store or shipping to the next convention location. When table 10 is in the fully closed position, all parts of table 10 are still interconnected by the hinge pieces. This interconnection prevents any loss of the various component parts of table 10 during movement, shipping or storage of table 10. This interconnection feature is of substantial importance as the loss of product display unit parts is responsible for significant monetary losses attributable to broken and disabled display equipment in department stores. The interconnection feature is even more critical to "on-the-road" sales forces traveling from one product show or convention site to another. In such traveling sales shows the loss of a display unit component can render the display table or unit inoperable and result in the loss of valuable convention show space. When the sales force is on the road there is simply not time to arrange for the shipment of new pieces from home or from the manufacturer.

Referring to FIG. 4, table 10 of FIG. 1 is inverted so that the underside features and connections of table 10 are shown. As previously stated, front and rear panels 12, 14 are secured to end panels 13, 15 by catch mechanism 45. Such catch mechanisms are well known in the art and catch 45 may be of any of the many type of catches available. Depending on the use of table 10 it may be desirable to have a friction catch in which a nipple is pressed into frictional capture by collar. Release of this type of catch is effected by simply pulling outwardly on the nipple portion to free it from the collar. It will be appreciated that a spring release catch may be used, but can suffer the drawback of being released as customers bump against the front or rear panel 12, 14.

Still referring to FIG. 4, the connection hinge 48 is shown which secures end panels 13, 15 to display surface 11. Connection hinge 47 which attaches front and rear panels 12, 14 to display surface 11 is shown in FIG. 1. The connection hinges provide strong, secure attachment of the panels to display surface 11. It is preferred that the hinges be thin or inserted into grooves in the panels so panels 12, 14, 13, and 15 are not widely spaced from table display surface 11. One such hinge suited to this purpose is known as a piano hinge and which extends the length of display surface 11 at the point of interconnection of front and rear panels 12, 14 and end panels 13, 15.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

It is also to be understood that the following claims are intended to cover all of the generic and specific features of the invention herein described, and all statements of the scope of the invention which, as a matter of language, might be said to fall there between.

Having now described the features, discoveries and principles of the invention, the manner in which the improved folding promotional table is constructed and used, the characteristics of the construction, and advantageous, new and useful results obtained; the new and useful structures, devices, elements, arrangements, parts and combinations, are set forth in the appended claims.

What is claimed as new and desired to secured by Letters Patent is as follows:

1. A foldable display table comprising:

a table top-edge, a display surface downwardly-spaced from said table top edge, said display surface having a front edge, a back edge, a first side edge and a second side edge, a perimeter sidewall enclosing said display surface, said sidewall extending downwardly from said table top edge to contact and enclose said display surface, said perimeter sidewall comprising:

a front panel presenting a top edge and a bottom edge, said front panel being hingedly connected to said display surface front edge, said front panel being movable between open and closed positions such that when said front panel is in said open position said front panel top edge is spaced vertically from said display surface to form a front side of said table top edge, and said panel forms a front sidewall segment of said perimeter sidewall, a rear panel presenting a top edge and a bottom edge, said rear panel being hingedly connected to said display surface back edge, said rear panel being movable between open and closed positions such that when said rear panel is in said open position said rear panel top edge is spaced vertically from said display surface to form a back side of said table top edge and said panel forms a back sidewall segment of said perimeter sidewall, a first end panel having a top edge and a bottom edge, said first end panel being hingedly connected to said display surface first side edge and being movable between open and closed positions such that when said first end panel is in said open position said first end panel top edge is spaced vertically from said display surface to form a first end of said table top edge and said first end panel forms a first end sidewall segment of said perimeter wall, and said first end panel bottom edge extends to support and space said display surface from the ground, a second end panel having a top edge and a bottom edge, said second end panel being hingedly connected to said display surface second side edge and being movable between open and closed positions such that when said second end panel is in said open position said second end panel top edge is spaced vertically from said display surface to form a second end of said table top edge and said second end panel forms a second end sidewall segment of said perimeter wall, and said second end panel bottom edge extends to support and space said display surface from the ground, said front, rear, first end, and second end sidewall segments contacting the adjacent panels to form said perimeter sidewall and to generally enclose said display surface and, said front and rear and first end and second end panels being hingedly collapsible into said closed position and against said display surface to form a generally parallel-planar, interconnected array comprising said panels folded flat against said display surface to reduce the space occupied by said display table to allow interconnected, compact storage and cartage of the display table.

2. The display table as claimed in claim 1 further comprising a mechanical catch for interlocking said front and rear panels with said end panels when said front and rear and end panels are in said open position to prevent said panels retracting into said closed position.

3. The display table as claimed in claim 1 wherein one of said front and said rear panels is collapsed to said closed position to provide an enlarged display surface and to permit a wheelchair to be partially moved under the display table for close access to said display surface by wheelchair bound individuals and to reduce the height obstruction to viewing of the display surface presented by said front and said rear panels.

4. The display table as claimed in claim 3 further comprising a mechanical catch for interlocking said end panels with one of said front and said rear panels when only one of said front and rear and end panels is in said open position to prevent said panels retracting into said closed position.

* * * * *